US005593749A

United States Patent [19]

Instance

[11] Patent Number: 5,593,749

[45] Date of Patent: Jan. 14, 1997

[54] LABELS AND MANUFACTURE THEREOF

[76] Inventor: David J. Instance, Guinea Hall, Sellindge, Kent, TN25 6EG, United Kingdom

[21] Appl. No.: 373,213

[22] PCT Filed: May 27, 1994

[86] PCT No.: PCT/GB94/01151

§ 371 Date: Jan. 12, 1995

§ 102(e) Date: Jan. 12, 1995

[87] PCT Pub. No.: WO94/28530

PCT Pub. Date: Dec. 8, 1994

[30] Foreign Application Priority Data

May 27, 1993 [GB] United Kingdom ..... 9310951

[51] Int. Cl.[6] ..... B31D 1/02; G09F 3/02

[52] U.S. Cl. ..... 428/40.1; 281/2; 281/5; 283/81; 283/101; 156/253; 156/267; 156/268; 156/269; 156/270; 156/290; 156/291; 156/299; 156/300; 156/301; 156/303; 428/41.8; 428/124; 428/126; 428/192; 428/194; 428/195

[58] Field of Search ..... 428/40, 41, 42, 428/124, 126, 192, 194, 195, 77; 156/253, 267, 268, 269, 270, 290, 291, 299, 300, 301, 303; 283/81, 101; 281/2, 5

[56] References Cited

U.S. PATENT DOCUMENTS

| | | | |
|---|---|---|---|
| 5,127,676 | 7/1992 | Bockairo | 428/40 |
| 5,264,265 | 11/1993 | Kaufmann | 428/40 |
| 5,290,616 | 3/1994 | Cowan | 428/40 |
| 5,399,403 | 3/1995 | Instance | 428/40 |

FOREIGN PATENT DOCUMENTS

| | | |
|---|---|---|
| 0284703 | 10/1988 | European Pat. Off. . |
| 386849 | 9/1990 | European Pat. Off. . |
| 0386849 | 11/1990 | European Pat. Off. . |

*Primary Examiner*—Nasser Ahmad

*Attorney, Agent, or Firm*—Rothwell, Figg, Ernst & Kurz

[57] ABSTRACT

A self-adhesive label comprising a self-adhesive base portion which is adhered by its self-adhesive surface to a backing of release material, a folded leaflet portion which is disposed over the base portion and a self-adhesive overlaminate portion which is adhered by its self-adhesive surface to a part of the top surface of the folded leaflet portion and to exposed parts of the top surface of the base portion on opposed sides of the folded leaflet portion so as to retain the leaflet portion in a folded configuration, the overlaminate portion exposing an end part of the folded leaflet portion whereby the end part can be pulled by user thereby to open the label. The invention also provides a method of producing such labels.

20 Claims, 4 Drawing Sheets

LABELS AND MANUFACTURE THEREOF

BACKGROUND OF THE INVENTION

The present invention relates to a self-adhesive label and to a method of producing self-adhesive labels.

It is known to manufacture so-called "extended text" multilaminar self-adhesive labels for application to products, the labels being openable so as to reveal previously hidden printed areas.

SUMMARY OF THE INVENTION

The present invention aims to provide an improved extended text self-adhesive label.

Accordingly, the present invention provides a self-adhesive label comprising a self-adhesive base portion which is adhered by its self-adhesive surface to a backing of release material, a folded leaflet portion which is disposed over the base portion and a self-adhesive overlaminate portion which is adhered by its self-adhesive surface to a part of the top surface of the folded leaflet portion and to exposed parts of the top surface of the base portion on opposed sides of the folded leaflet portion so as to retain the leaflet portion in a folded configuration, the overlaminate portion exposing an end part of the folded leaflet portion whereby the end part can be pulled by user thereby to open the label.

The present invention also provides a method of producing a succession of self-adhesive labels carried on a backing of release material, the method comprising the steps of:

(a) providing a laminar material comprising a web of self-adhesive base material carried on a backing web of release material;

(b) applying a succession of folded leaflets to the top surface of the web of base material;

(c) applying a self-adhesive overlaminating web over the folded leaflets and exposed parts of the top surface of the web of base material; and (d) cutting through the overlaminating web, the folded leaflets and the base material as far as the backing of release material so as to form a succession of self-adhesive labels on the backing of release material, the overlaminating step (c) and the cutting step (d) being carried out so that in each self-adhesive label a portion of a respective folded leaflet is sandwiched between a portion of the overlaminating web and a portion of the base material web, with a part of the folded leaflet portion being exposed.

BRIEF DESCRIPTION OF THE DRAWINGS

Embodiments of the present invention will now be described by way of example only with reference to the accompanying drawings, in which.

DETAILED DESCRIPTION OF THE DRAWINGS

Figure 1:
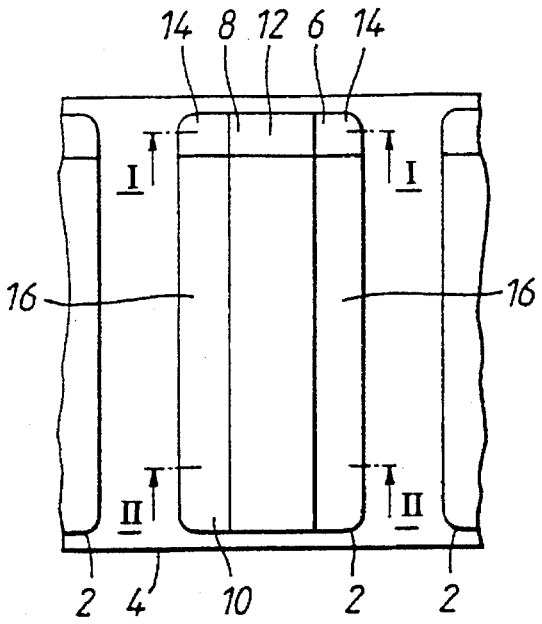
FIG. 1 is a plan view of a succession of self-adhesive labels carried on a backing of release material in accordance with an embodiment of the present invention.
Figure 2:
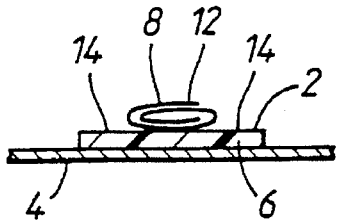
FIG. 2 is a section on line A—A of the self-adhesive label shown in FIG. 1.
Figure 3:
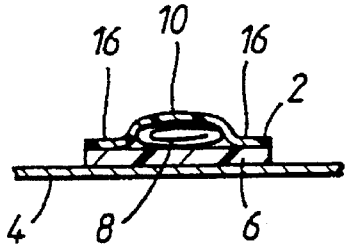
FIG. 3 is a section on line B—B of the self-adhesive label shown in FIG. 1.

Referring to FIGS. 1 to 3, there is shown a self-adhesive label 2 in accordance with an embodiment of the present invention. It will be seen from FIG. 1 that a succession of such self-adhesive labels 2 is carried on a backing 4 of release material, such as silicon coated paper. Each label 2 includes a lowermost self-adhesive base portion 6 which is coated on its rear surface with a pressure-sensitive adhesive and is adhered thereby to the backing 4 of release material. The base portion 6 preferably comprises a transparent plastics layer, for example of polypropylene. However, it may be comprised of paper. A folded leaflet portion 8 is disposed over the base portion 4 and extends transversely across the self-adhesive label 2. The folded leaflet portion 8 preferably comprises a paper sheet which has been folded with a plurality of folds so as to have a number of layers. A variety of different folded configurations can be employed in accordance with the present invention. For example, the leaflet portion 8 may have a plurality of fold lines so as to comprise 32 pages. A self-adhesive overlaminate portion 10 has a rear surface coated with a pressure-sensitive adhesive and the rear surface is adhered over a part of the upper surface of the leaflet portion 8 and to parts of the upper surface of the base portion 6 on opposed sides of the leaflet portion 8 so as to adhere the folded leaflet portion 8 in a closed configuration to the base portion 6. The overlaminate portion 10 preferably comprises a self-adhesive transparent plastics material, such as polypropylene, although it may be comprised of paper. The preferred plastics material of the overlaminate portion 10 preferably has a smaller thickness than the preferred plastics material of the base portion 6. The overlaminate portion 10 covers a major portion, but not all, of the upper surface of the self-adhesive label 2 so that at one edge of the self-adhesive label 2 an end part 12 of the folded leaflet portion 8 and adjacent parts 14 of the base portion 6 are exposed. The end part 12 can be pulled by a user so as to separate the folded leaflet portion 8 and the overlaminate portion 10 adhered thereover from the base portion 6. The folded leaflet portion 8 can then be unfolded and read by a user. In order to assist the removal of the overlaminate portion 10 from the base portion 6, the entire surface of the base portion 6 may have been pre-coated with a UV curable varnish which assists in partially deadening the adhesive interface between the pressure-sensitive adhesive on the overlaminate portion 10 and the upper surface of the base portion 6 so as to assist removal of the overlaminate portion 10 from the base portion 6.

It will be seen from FIG. 1 that three edges of the overlaminate portion 10 are coincident with corresponding edges of the base portion 6, which edges have been cut in a single cutting step so that the overlaminate portion 10 has wing portions 16 on the opposed sides of the leaflet portion 8 which are large in area and tend to prevent the folded label from being inadvertently opened. The two end edges of the folded leaflet portion 8 are preferably coincident with corresponding end edges of the base portion 6, those edges having been cut in a single cutting step.

Figure 4A:
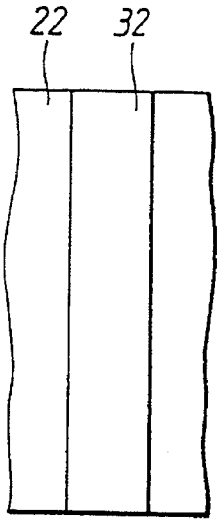
FIGS. 4(*a*),(*b*) and (*c*) show in sequence the web assembly during the manufacture of the self-adhesive labels shown in FIG. 1 in accordance with a first embodiment of the method of the present invention.
Figure 4B:
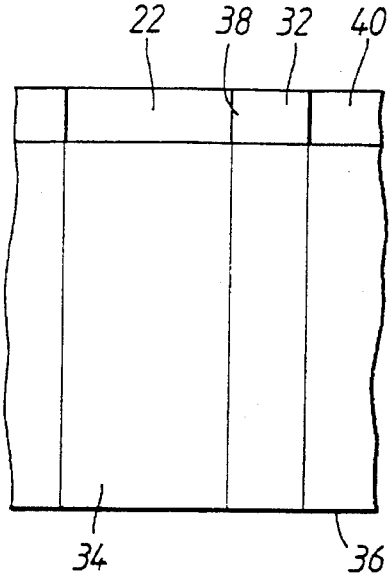
Figure 4C:
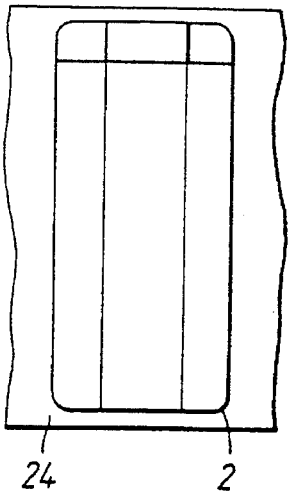
Figure 5:
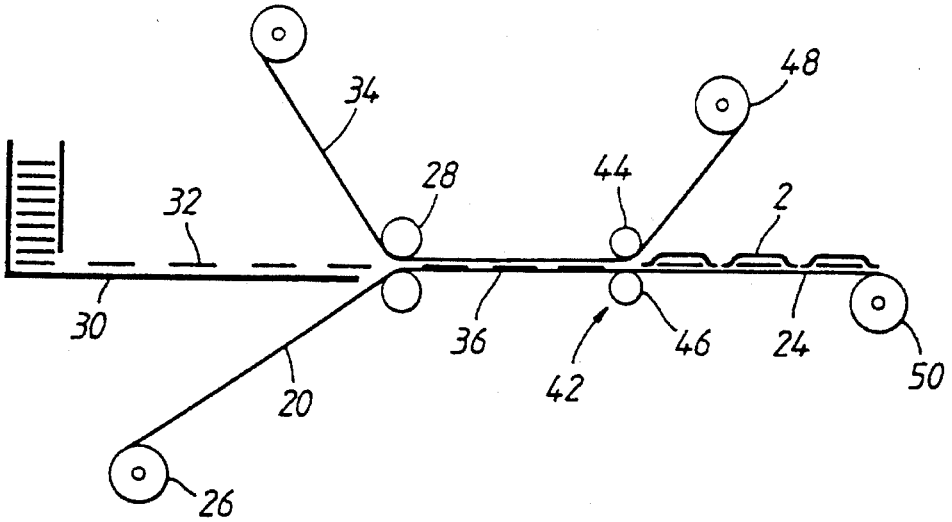
FIG. 5 is a schematic side view of an apparatus for producing self-adhesive labels in accordance with the method of FIG. 4.

A first embodiment of method of manufacturing the self-adhesive labels of FIGS. 1 to 3 is illustrated in FIGS. 4 and 5.

Initially, a laminar material 20 comprising a web of self-adhesive base material 22 carrying a backing web of release material 24 is fed out from a reel 26 thereof between a pair of rollers 28. A feeding device 30 applies a succession of the folded leaflets 32 to the upper surface of the base material 22 as shown in FIG. 4(*a*). The folded leaflets 32 are preferably, as shown in FIG. 5, assembled onto the base material web 22 at the rollers 28 at which, in addition, a web 34 of self-adhesive overlaminating material is laminated over the folded leaflets 32 and the base material 22 so as to form a composite web 36 in which a succession of leaflets 32 is sandwiched between the overlaminating web 34 and the base material web 22. As shown in FIG. 4(*b*) the overlaminating web 34 is narrower in width than the base material web 22. The overlaminating web 34 and the base material web 22 are longitudinally offset so as to have a coincident longitudinal edge on one side of the composite web 36 so that on the other side of the composite web 36 end parts 38 of the folded leaflets 32 are exposed together with edge portions 40 of the base material web 22. The composite web 36 is then fed to a die-cutting station 42 comprising a die-cutting roller 44 and a backing roller 46. At the die-cutting station 42, the composite web 36 is cut by cutting through the overlaminating web 34, the applied leaflets 32 and the base material web 22 as far as, but not through, the backing web 24 of release material so as to form the self-adhesive labels 2 on the backing web 24 of release material, as shown in FIG. 4(*c*). The cutting is carried out so that the two opposed ends of the folded leaflet 32 are cut away so that the cut ends of the folded leaflet portion in the resultant self-adhesive label 2 are coincident with edges of the label 2. Alternatively, the edge of the end part 38 of the leaflet 32 is not cut away, the cut edge of the base material 22 being substantially coincident with the edge of the end part 38. The waste produced during the cutting step, consisting of a matrix of the base material 22 having adhered thereto cut away parts of the folded leaflets 32 and a waste matrix of the overlaminating material 34, is removed and wound into a reel 48. The succession of self-adhesive labels 2 carried on the backing web 24 of release material is wound into a reel 50.

Figure 6:
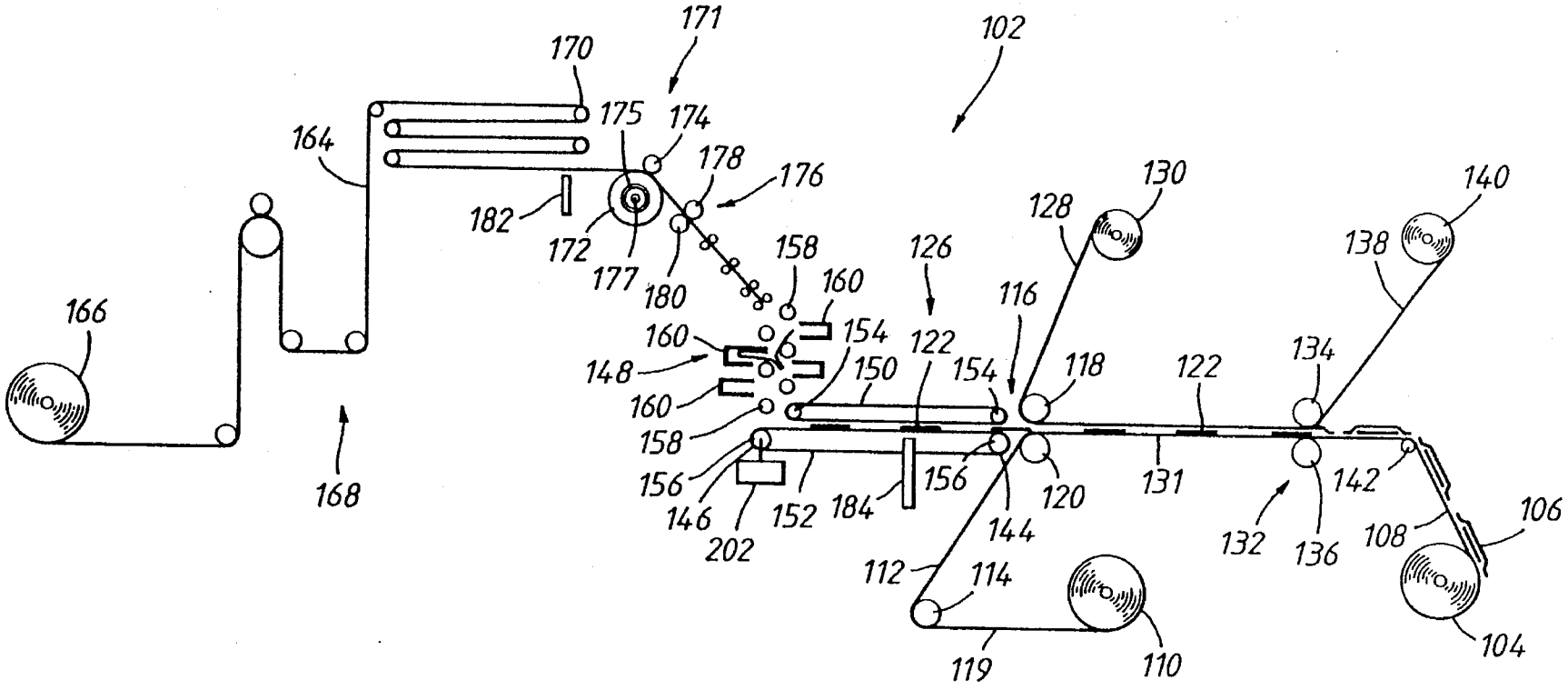
FIG. 6 is a schematic side view of an apparatus for producing the self-adhesive labels of FIG. 1 in accordance with a second embodiment of the method of the present invention.
Figure 7:
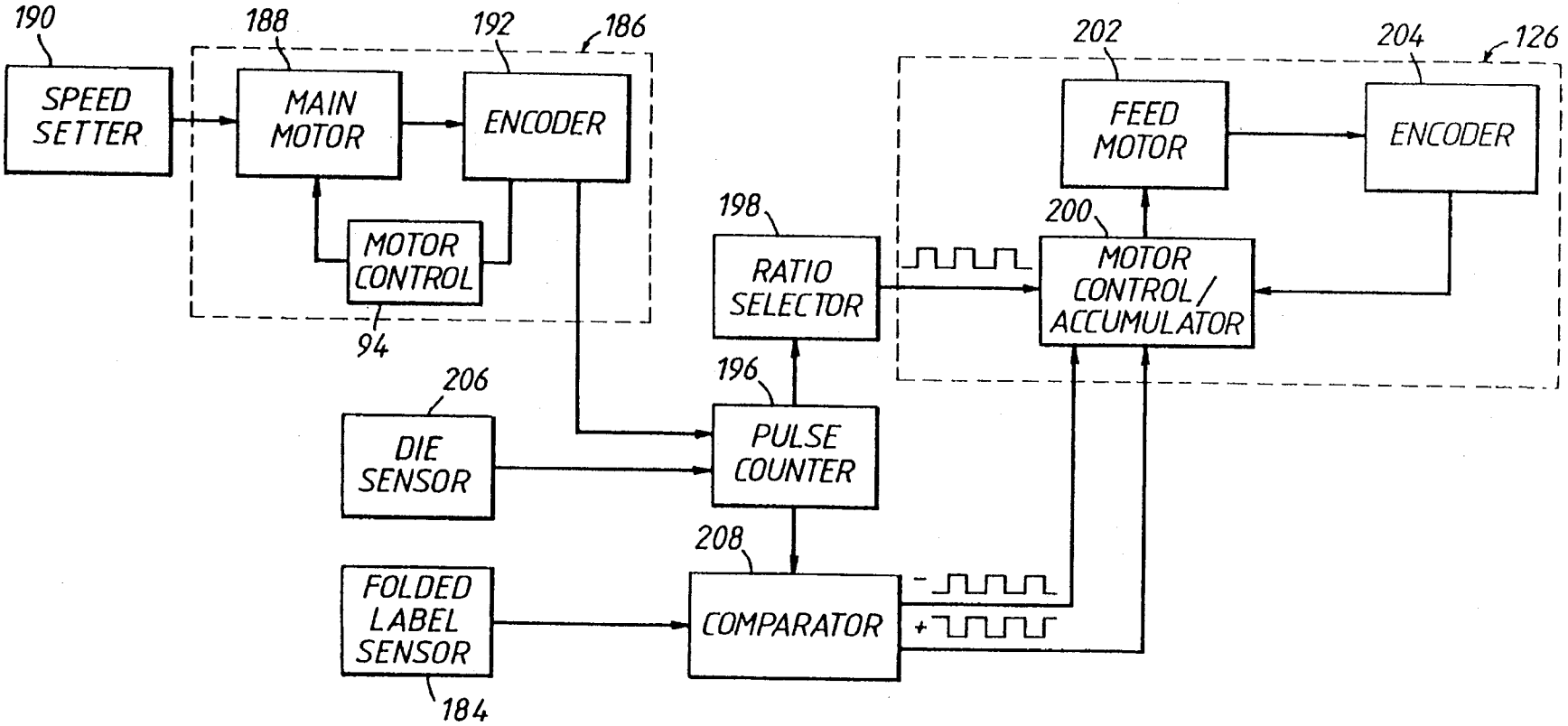
FIG. 7 is a schematic representation of the control system of the apparatus of FIG. 6.

A second embodiment of a method of producing labels in accordance with the invention is illustrated in FIGS. 6 and 7.

Referring to FIG. 6, there is shown an apparatus, designated generally as 102, for producing a reel 104 carrying a succession of self-adhesive labels 106. The reel 104 comprises an indeterminate length of a backing web 108 of release material, typically comprising a silicone-faced backing paper. The backing web 108 is provided in a reel 110 of duplex labelstock material 109 comprising a self-adhesive web 112 of paper or plastics which is coated on its reverse side with pressure-sensitive adhesive and is carried on the release material web 108. The reel 110 is mounted in the apparatus 102 as a supply reel which is fed out over one or more guide rollers 114 to a label applying station, designated generally as 116, which includes a pair of opposed rollers 118,120 between which the labelstock material 109 is passed. At the label applying station 116, individual folded printed labels 122 are fed between the rollers 118,120 by a label feed system designated generally as 126, whereby the folded labels 122 are applied to the upper surface of the self-adhesive web 112. A self-adhesive laminate 128, typically of plastics, is fed out from a supply reel 130 and between the rollers 118,120 so as to be laminated by its self-adhesive surface over the folded labels 122 which have been applied to the underlying web 112 of self-adhesive material. The folded labels 122 are thereby adhered to the self-adhesive web 112. The combined web/label assembly 131 is conveyed to a die-cutting station designated generally as 132 which includes an upper die-cutting roller 134 with a lower opposed backing roller 136. The die-cutting station 134 is downstream in the direction of web movement from the label feed system 126. At the die-cutting station 132, the resultant self-adhesive labels 106 are cut out from the overlying laminar material 128, the folded labels 122 and the self-adhesive web 112. The release web 108 is not cut. The waste web skeleton 138 which may include waste pieces of the folded labels 122 is wound up on a waste reel 140 and the web of release backing material 108 carrying the succession of self-adhesive labels 106 is wound up on reel 104 as a take-up reel, the backing material web 108 having been fed over one or more guide rollers 142.

The label feed system 126 has an output end 44 past which the labelstock material 109 comprising the self-adhesive web 112 carried on the web 108 of release backing material is moved by a web conveying system comprising a drive unit (not shown) and the supply and take-up reels 104 and the guide rollers 114,142, the drive unit rotating at least the take-up reel 104 and optionally the supply reel 104 and/or one or more of the guide rollers 114,142. The label feed system 126 also includes an input end 146 which is disposed beneath a sheet folding unit designated generally as 148. The label feed system 126 has a conveying device which comprises upper and lower endless belts 150,152 which are mounted between respective pairs of rollers 154,156. The endless belts 150,152 are rotatably driven by the respective rollers 154,156 at least one of which is in turn driven by a feed motor 202 so as to move folded labels 122 in succession from the input end 146 at which folded labels 122 are received from the folding unit 148 to the output end 144 at which folded labels 122 are fed onto the self-adhesive web 112 between the rollers 118,120.

The folding unit 148 is of generally known construction and comprises a zig-zag array of folding rollers 158 together with a zig-zag array of folding pockets 160 on opposed sides of the array of rollers 158. In use, the folding rollers 158 rotate continuously to drive a sheet through the folding unit 148. In use, a sheet 162 is fed through the uppermost pair of rollers 158 and into the uppermost folding pocket 160. When the leading edge of the sheet 62 hits the end of the folding pocket 160, the sheet 162 continues to be fed by the rollers 158 and the initially flat sheet 162 is then upset by this continued feeding so as to have a folded configuration with a single fold. The location of the fold in the sheet 162 is determined by the depth of the folding pocket 160. The single folded sheet 162 is then fed by the next pair of rollers 158 (i.e. the second and third rollers) in the zig-zag array into the second folding pocket 160 and in the same way a second fold line is formed. This process continues until the desired folded sheet 162 is achieved, the sheet having a number of fold lines corresponding to the number of folding pockets 160. The resultant fully folded label 122 is then fed out from the lowermost pair of rollers 158 between the endless belts 150,152 of the label feed system 126.

The folding unit 148 is supplied continuously with printed sheets 162 which have been formed from a single printed web 164 which has been fed out from a supply reel 166 thereof. The web 164 has typically been printed on one or both sides by a flexographic, letterpress, digital offset or lithographic offset printing technique. The printed web 164 is fed out from the reel 166 by a web unwind and guide apparatus, designated generally as 168, and the web is fed to a festoon 170 at which a supply length of the printed web 164 is tensioned. The web 164 then passes between a drive roller 172 and an upper opposed roller 174 of a web feed system 171 which feeds the web intermittently to a cutting device 176 comprising a cutting roller 178 and an opposed backing roller 180. The cutting device 176 cuts off a desired length of the printed web to form a separate printed sheet 162 which is then fed into the folding unit 148.

The drive roller 172 is driven by an electromagnetic clutch 175 which has its input shaft 177 continuously driven. The electromagnetic clutch 175 is actuated intermittently so as to rotate the drive roller 72 when the printed web 164 is required to be fed through the cutting device 176.

The feed motor 202 continuously drives not only at least one of rollers 154,156 thereby continuously rotating the endless belts 150,152 of the label feed system 126 but also continuously drives the folding rollers 158 of the folding unit 148 and the input shaft 177 of the electromagnetic clutch 175 of the drive roller 172 for the printed web 164. Preferably, the driven roller or rollers 154,156, the folding rollers 158 and the input shaft 177 are mechanically geared together, thereby providing a mechanical coupling between the web feed system 171, the folding unit 148 and the label feed system 126.

The apparatus 102 includes a number of sensors, with associated control systems, for controlling and coordinating the operation of the various parts of the apparatus 102. A printed web sensor 182 is provided between the festoon 170 and the drive roller 172 for the printed web 164. The sensor 172, which is typically a photodetector, is adapted to detect a series of printed marks along the printed web 164. The detection of each printed mark causes a detection signal to be generated which switches off the electromagnetic clutch 175 for the drive roller 172 and actuates the cutting device 176 when the web 164 has stopped. The cutting device, and the web drive, are thereby operable in response to a detection signal from the sensor. This ensures that accurately cut printed sheets 162 are formed from the printed web 164, each printed sheet 162 having the required length and being registered with respect to the printing on the web 164. The web 164 is then moved again through the cutting device 176 after a short delay in the next cycle by actuation of the electromagnetic clutch 175 for the drive roller 172.

A second sensor 184 is provided in the label feed system 126 and is adapted to detect each folded label 122 as it passes along the label feed system 126. The sensor 184 is typically a photodetector which is adapted to detect either an edge, for example the leading edge, of each folded label 122 or a printed registration mark on each folded label 122. The second sensor is adapted to control the application of the folded label 122 to the self-adhesive web 112 so that it is in registry with the die-cutting roller 134. This registration is employed when the web 109 is not pre-printed, pre-cut or otherwise provided with a succession of registration points along the length of the web 109. The second sensor 184 controls the application of the folded label 122 by varying the speed of the feed motor 202 in the manner described below. The variation of the speed of the feed motor 202 causes corresponding speeding up or slowing down of the web feed system 171, the folding unit 148 and the label feed system 126 which are coupled together.

An embodiment of a control system for controlling and coordinating the operation of the label feed system 126, together with the web feed system 171 and the folding unit 148, the web conveying system and the die-cutting roller 134 of FIG. 6 will now be described with reference to FIG. 7. The web conveying system 186 comprises a main motor 188 which drives the take-up reel 104 and preferably at least one of the supply reel 110, the guide rollers 114,142 and the rollers 120 and 136. A speed setter 190 inputs a digital signal into the main motor 188 representative of the desired web speed. The main motor 188 is connected to an encoder 192 which is adapted continuously to output a series of pulses, the instantaneous rate of which is related to the actual speed of the main motor 188. The pulses are received by a motor control 194 which compares the instantaneous pulse rate with the rate of the desired set speed and if there is a difference in those two rates, the motor control 194 outputs a feedback signal which is received by the main motor 188 and instantaneously corrects the speed of the main motor 188.

This feedback control provides continuous instantaneous control of the speed of the main motor 188 so that at any given time the actual speed is the same as the desired set speed.

The encoder 192 also outputs a pulse signal, comprising a series of pulses at a particular rate, to a pulse counter 196. Each pulse is representative of a specific angular rotation of the main motor 188 and thus is representative of a specific distance which the labelstock web material has moved as a result of being driven by the main motor 188.

The pulse counter 196 outputs a series of pulses to a ratio selector 198. However, in an alternative arrangement, the series of pulses could be outputted directly to the ratio selector 198 from the encoder 192. The ratio selector 198 can be set to a predetermined ratio, typically to four decimal places, so that the pulse rate output therefrom is a predetermined ratio of the pulse rate input from the pulse counter 196. The output of pulses from the ratio selector 198 is fed to a motor control 200 for a feed motor 202 of the label feed system 126. The motor control 200 outputs a pulsed motor control signal to the feed motor 202 and the feed motor 202 rotates at a speed governed by the pulse rate of the pulsed motor control signal. In this way, the pulsed motor control signal controls the feed motor 202 and thereby the rate at which folded printed labels 122 are delivered onto the self-adhesive web 112 by the label feed system 126. The rate at which the printed web 164 is fed by the web feed system 171, thereby controlling the rate at which printed sheets 162 are fed into the folding unit 148, and the rate of operation of the folding unit 148 are also correspondingly controlled because the web feed system 171 and the folding unit 148 are geared to the label feed system 126.

In a manner similar to that of the main motor 188, the feed motor 202 is connected to an encoder 204 which is adapted continuously to output a series of pulses, the instantaneous rate of which is related the actual speed of the feed motor 202. The pulses are received by the motor control 200 which compares the instantaneous pulse rate with the rate of the desired set speed. If there is a difference in the two pulse rates, the motor control 200 outputs a feedback signal which may be positive or negative depending on whether the feed motor 102 is running slow or fast. The feedback signal is added arithmetically to the pulsed input from the ratio selector 198 to form the pulsed motor control signal which is fed to the feed motor 202. Thus the pulsed motor control signal may be continuously varied to ensure that the feed motor 202 is running at a speed that is at the desired ratio of the speed of the main motor 188. It will be understood that the motor control 200 also acts as a pulsed signal accumulator.

In this way the web conveying system and the label feed system can be arranged to run at a set speed ratio, the speed ratio being related to the length of each finished label, the length of each folded label which is applied to the web and the spacing between the folded labels on the web.

The label feed system 126 is also controlled with respect to the die-cutting roller 134 so as to ensure that when each folded printed label 122 is applied to the self-adhesive web 112, the folded printed label 122 is applied at substantially the correct position, irrespective of any fluctuations or variations in the position of the folded printed labels upstream of the sensor 184 in the label feed system 126 and the folding unit 148, so that when the folded printed label 122 is cut by the die-cutting roller 34 at the die-cutting station 132, the die-cut is substantially in registration with the folded printed label 122.

The die-cutting roller 134 is provided with a die-sensor 206. The die-sensor 206 detects when the die-cutting roller 134 is at a prescribed angular orientation and thus correlates the die-cutting roller 134 with respect to a particular stage of the die-cutting cycle. For example, the die-sensor 206 may be arranged to emit a die-signal at the commencement of a rotary die-cutting operation. The die-sensor 206 is adapted to input a die-sensor signal to the pulse counter 196 which triggers the pulse counter 196 into outputting a pulse count signal to a comparator 208. The folded label sensor 184 also sends a signal to the comparator 208 when it detects a folded label 122. The two signals from the pulse counter 196 and the folded label sensor 184 received by the comparator 208 are processed and compared to yield an error signal which is indicative of any distance which the actual position of the detected folded label 122 in the label feed system 126 leads or lags a desired position which is in registry with respect to the die-cutting roller 134. Such an error signal is outputted by the comparator 208 to the motor control accumulator 200 of the label feed system 126. This causes the feed motor 202 of the label feed system 126 to be instantaneously speeded up or slowed down thereby to advance or retard the application to the self-adhesive web 112 of the detected folded label 122 in the label feed system 126 so that that detected folded label 122 is applied to the self-adhesive web 112 at the correct position with respect to the downstream die-cutting operation by the die-cutting roller 134. In this label producing apparatus, the die-cutting roller 134 defines the position of the resultant self-adhesive labels 106 along the web of release material 104 and the position of the folded printed labels 122 is registered on the labelstock web 109 with respect to the die-cutting roller 134. Thus the folded printed labels 122 in the label feed system 126 chase the position of the die-cutting roller 134 and each folded printed label 122 is applied to a target position on the web 112 which is correlated to a subsequent die-cut made by the die-cutting roller 134.

The operating speeds of the printed web feed system 171 and the folding unit 148 are preset with respect to the set speed of the label feed system 126 so that folded sheets 122 are fed at a desired rate from the folding unit 148 into the label feed system 126, but those operating speeds are varied in synchronism with any variation in the actual speed of the label feed system as a result of the coupling of those components together.

In operation, the web drive unit 168 continuously feeds the printed web 164 into the festoon 170, and any slack in the web 164, as a result of the intermittent operating of the drive roller 172 as described below, is taken up by the web drive unit 168. The drive roller 172 feeds the printed web 164 through the cutting device 176 until the sensor 182 detects the next printed mark on the printed web 164. At this point, the desired length of the printed web 164 has been fed through the cutting device 176. The drive roller 172 is instantaneously stopped by the electromagnetic clutch 175 to stop the web movement through the cutting device 176 and the cutting roller 178 is actuated to cut the desired length from the printed web 164. The cut sheet 162 is then fed into the folding unit 148, folded to the desired folded configuration and then fed between the endless belts 150,152 of the label feed system 126. After the cutting operation, the web drive roller 172 is started again to commence the next feeding, cutting and folding cycle.

The label feed system 126 operates continuously and applies the succession of folded printed labels 122 onto the continuously moving web 112. As described hereinabove, the speed of the label feed system 126 is set to be a particular ratio of the speed of the web conveying system and the application of each folded printed label 122 to the web 112 is controlled with respect to the position of the die-cutting roller 134.

The folded printed sheets 122 are adhered to the self-adhesive web 112 by the self-adhesive laminar material 128 and then the combined assembly 131 is die-cut at the die-cutting station 132 and the waste 138 removed.

In an alternative arrangement, the printed web 164 may be cut to form printed sheets 162 with waste web portions between adjacent printed sheets 162. The cutting unit 176 may then be adapted to effect two cuts during one cutting cycle, the first cut to cut off the printed sheet 162 and the second cut to cut of a waste web portion. The waste web portion may be ejected from the web feed system or the folding unit and discarded. This arrangement may be employed when the printed web 164 is printed with a repeat length which is not the same as the length of the printed sheet. This enables the apparatus to utilise webs having fixed repeat lengths irrespective of variations in size of the printed sheets 162. This is an important advantage because it enables the use of webs printed with fixed repeat lengths to be used, for example those produced by a digital offset or lithographic offset printing process which enables high quality printed images to be printed on the labels, for varying lengths of printed sheets.

The present invention provides a self-adhesive label which is, by the use of a plastics overlaminating layer, protected against soiling or damage during transport and prior to use. However, when it is desired to open the label, a relatively small part of the folded leaflet can be pulled away from the self-adhesive base of the label to enable the label to be opened. The labels of the present invention are readily and economically manufactured because a succession of the folded leaflets is sandwiched between two self-adhesive webs. The use of two webs of different widths, but which are offset relative to each other, enables the desired configuration to be achieved which incorporates an exposed part of the folded leaflet, in combination with only a single die-cutting step.

The self-adhesive label made in accordance with the present invention has particular application in labelling products such as pharmaceuticals in which a large amount of printed information is required to be provided on a relatively small area or "footprint" of the product.

I claim:

1. A self-adhesive label comprising:

a self-adhesive base portion which is adhered by its self-adhesive surface to a backing of release material, a folded leaflet portion which is disposed over the base portion and a self-adhesive overlaminate portion which is adhered by its self-adhesive surface to a part of the top surface of the folded leaflet portion and to exposed parts of the top surface of the base portion on opposed sides of the folded leaflet portion so as to retain the leaflet portion in a folded configuration, the overlaminate portion exposing an end part of the folded leaflet portion the exposed end part being of sufficient size to be pulled by a user thereby to open the label.

2. A self-adhesive label according to claim 1 wherein the overlaminate portion comprises a plastics layer.

3. A self-adhesive label according to claim 1 wherein the base portion comprises a plastics layer.

4. A self-adhesive label according to claim 3 wherein the base portion is coated with a material which partially deadens the adhesive interface between the self-adhesive surface of the overlaminate portion and the upper surface of the base portion.

5. A self-adhesive label according to claim 4 wherein the material comprises a varnish.

6. A self-adhesive label according to claim 5 wherein the varnish is a UV curable varnish.

7. A self-adhesive label according to claim 1 wherein the said end part is disposed at one edge of the self-adhesive label.

8. A self-adhesive label according to claim 7 wherein the end part is disposed between two exposed parts of the base portion.

9. A self-adhesive label according to claim 1 wherein the base portion has a thickness greater than that of the overlaminate portion.

10. A method of producing a succession of self-adhesive labels carried on a backing of release material, the method comprising the steps of:

(a) providing a laminar material comprising a web of self-adhesive base material carried on a backing web of release material;

(b) applying a succession of individual folded leaflets to the top surface of the web of base material;

(c) applying a self-adhesive overlaminating web over the folded leaflets and exposed parts of the top surface of the web of base material; and (d) cutting through the overlaminating web, the folded leaflets and the base material as far as the backing of release material so as to form a succession of self-adhesive labels on the backing of release material, the overlaminating step (c) and the cutting step (d) being carried out so that in each self-adhesive label a portion of a respective folded leaflet is sandwiched between a portion of the overlaminating web and a portion of the base material web, with a part of the folded leaflet portion being exposed.

11. A method according to claim 10 wherein the overlaminating web has a width less than that of the base material.

12. A method according to claim 11 wherein the overlaminating and base material webs are offset whereby the said parts of the folded leaflet portions are exposed and not covered by the overlaminating web.

13. A method according to claim 10 wherein in the cutting step (d) at least one of the folded leaflets is cut away.

14. A method according to claim 10 wherein the overlaminating web comprises a plastics web.

15. A method according to claim 10 wherein the base material comprises a plastics web.

16. A method according to claim 15 further comprising the step before applying step (b) of coating the base material with a material which, in the resultant labels, partially deadens the adhesive interface between the self-adhesive surface of the overlaminating web and the upper surface of the base material.

17. A method according to claim 16 wherein the material comprises a varnish.

18. A method according to claim 17 wherein the varnish is a UV curable varnish.

19. A method according to claim 10 wherein the said exposed part of the folded leaflet portion is disposed at one edge of the self-adhesive label between two exposed parts of the base material.

20. A method according to claim 10 wherein the base material has a thickness greater than that of the overlaminating web.

* * * * *